US005626298A

United States Patent [19]

Arnoldy

[11] Patent Number: 5,626,298

[45] Date of Patent: May 6, 1997

[54] TUB GRINDER WITH REAR DISCHARGE HAMMER MILL AND ANGLED SHEAR PLATES

[76] Inventor: Adrian F. Arnoldy, Box 127, 712 Gambrinus St., Tipton, Kans. 67485

[21] Appl. No.: 546,492

[22] Filed: Oct. 20, 1995

[51] Int. Cl.[6] ..... B02C 13/286

[52] U.S. Cl. ..... 241/101.761; 241/186.4; 241/195; 241/289

[58] Field of Search ..... 241/101.76, 186.4, 241/194, 195, 287, 289, 189.1

[56] References Cited

U.S. PATENT DOCUMENTS

| | | |
|---|---|---|
| 610,845 | 9/1898 | Freitag . |
| 2,066,621 | 1/1937 | Gray . |
| 2,222,074 | 11/1940 | Hauge . |
| 2,650,745 | 9/1953 | Oberwortman . |
| 2,875,956 | 3/1959 | Lykken et al. . |
| 2,877,956 | 3/1959 | Sackett . |
| 3,111,248 | 11/1963 | Pierson . |
| 3,615,059 | 10/1971 | Moeller . |
| 3,807,644 | 4/1974 | Van Ee . |
| 3,887,141 | 6/1975 | Francis . |
| 3,966,128 | 6/1976 | Anderson et al. . |
| 4,087,051 | 5/1978 | Moeller . |
| 4,088,272 | 5/1978 | Grillot . |
| 4,106,706 | 8/1978 | Burrows . |
| 4,193,556 | 3/1980 | Linnerz et al. . |
| 4,243,183 | 1/1981 | Eirich et al. . |
| 4,312,481 | 1/1982 | Carey et al. . |
| 4,485,976 | 12/1984 | White . |
| 4,693,426 | 9/1987 | White . |

OTHER PUBLICATIONS

Operator and Parts Manual for Roto Grind Tub Grinder of Burrow Enterprises of Greeley, Colorado; published prior to Oct. 1, 1994.

Sales literature of Western Land Roller Co. of Hastings, Nebraska for Bearcat 4200 Tub–Master Hay and Feed Grinder; published prior to Oct. 1, 1994.

Sales literature of Henke Machine, Inc. of Colombus,Nebraska for Kwikgrinder; published prior to Oct. 1, 1994.

Sales literature of Haybuster Manufacturing, Inc. of Jamestown, North Dakota for High–Capacity Portable Tub Grinders; published prior to Oct. 1, 1994.

Sales literature of Burrows Enterprises, Inc. of Greeley, Colorado for Roto Grind Tub Grinders; published prior to Oct. 1, 1994.

Sales literature of DewEze Manufacturing Co. of Harper, Kansas for Roto Cut Processor; published prior to Oct. 1. 1994.

Sales literature of Jones Manufacturing Co. of Beemer, Nebraska for Mighty Giant Hay Grinder Hydrafork Model; published prior to Oct. 1, 1994.

Sales literature of Jones Manufacturing Co. of Beemer, Nebraska for Mighty Giant Hay Grinder PTO Model; published prior to Oct. 1, 1994.

Sales literature of Jones Manufacturing Co. of Beemer, Nebraska for Mighty Giant Hay Grinder Power Unit Model; published prior to Oct. 1, 1994.

Sales literature of W.H.O. Manufacturing Co. of Lamar, Colorado for W.H.O. Tub Grinders; published prior to Oct. 1, 1994.

*Primary Examiner*—Mark Rosenbaum

*Attorney, Agent, or Firm*—Litman, McMahon and Brown, L.L.C.

[57] ABSTRACT

A tub grinder for grinding animal feed and the like of the type having a hammer mill extending below a stationary floor about which a tub side wall rotates, incorporates a rear discharge opening formed in a rear side wall of the hammer mill and includes deflector plates extending across an end wall of the grinder for directing material out the discharge opening to the rear of the tub grinder. Shear plates are adjustably secured to an end wall of the hammer mill housing. The shear plates are oriented in overlapping and angled relationship with respect to one another and to prevent ground materials from accumulating on the shear plates particularly when wet. Sickle blades are retractably positioned in the mill side walls for providing additional cutting action. Further, hammer assemblies are modified to include a knife edge and a face plate.

28 Claims, 3 Drawing Sheets

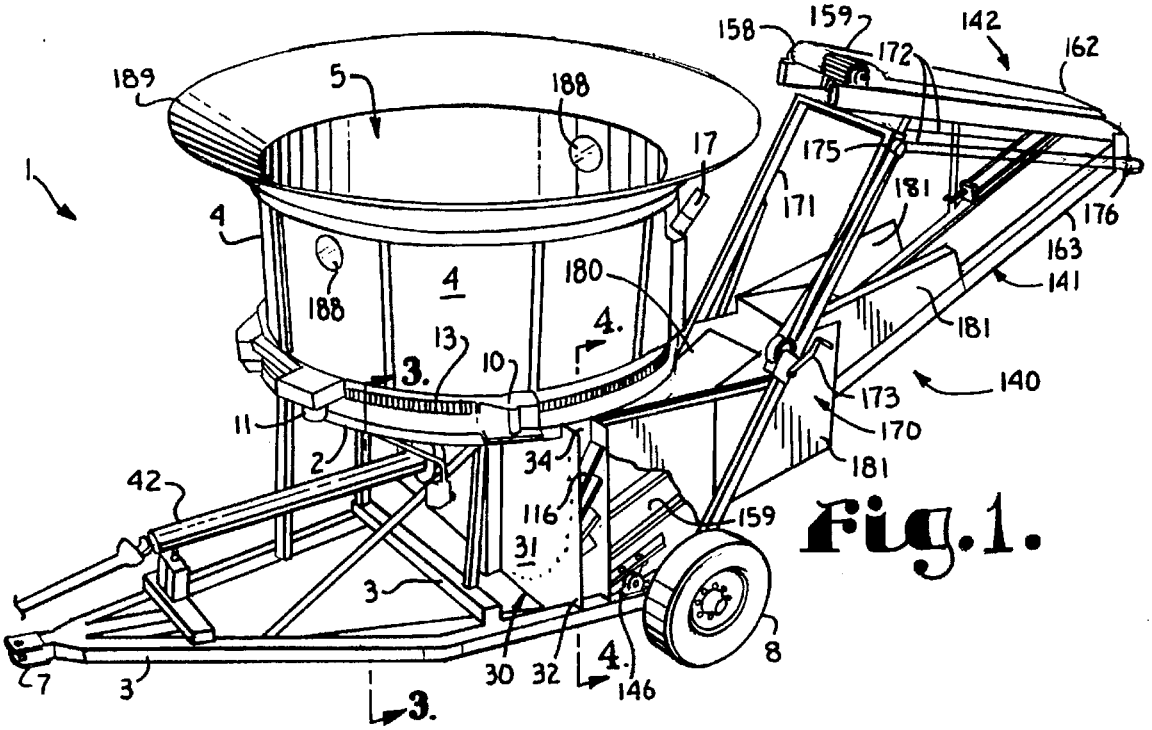
Fig. 1.
Fig. 2.
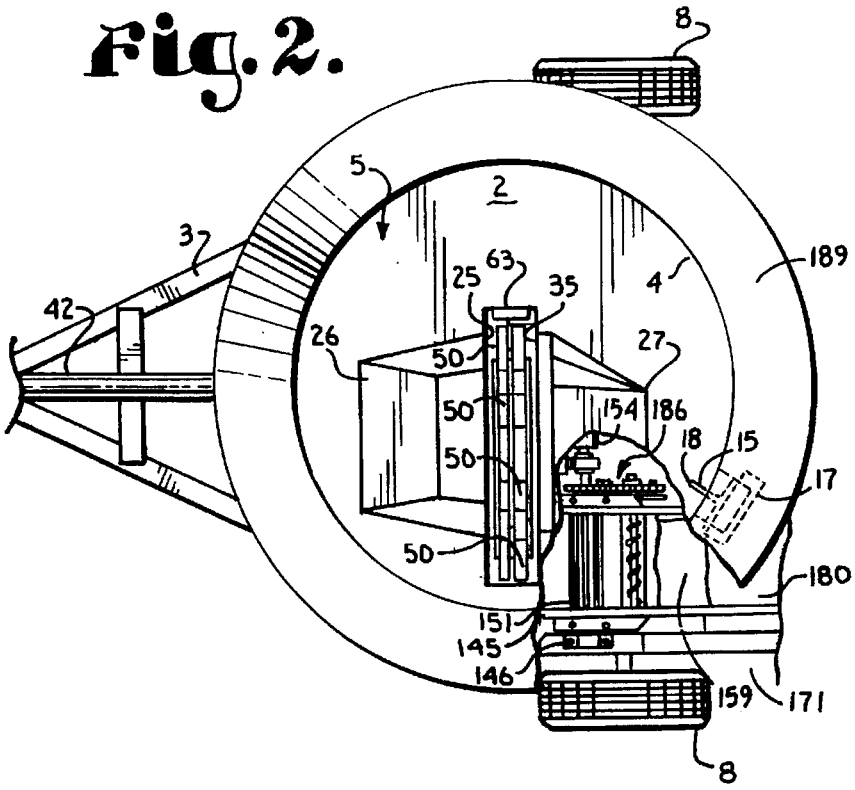

TUB GRINDER WITH REAR DISCHARGE HAMMER MILL AND ANGLED SHEAR PLATES

BACKGROUND OF THE INVENTION

The present invention relates to improvements to hammer mills used in association with apparatus for comminuting or chopping material such as animal feed and in particular improvements to hammer mills for tub grinders.

Tub grinders are used for chopping or grinding animal feed crops to facilitate consumption by livestock. Tub grinders are particularly well adapted for shredding, chopping and grinding large round bales of hay. Tub grinders generally comprise a stationary floor with a cylindrical side wall which rotates relative to the floor. At least one projection extending inwardly from the side wall is adapted to engage material positioned in the tub such as a round bale of hay causing the round bale to rotate with the cylindrical side wall relative to the floor. A hammer mill is generally secured below the floor of the tub grinder such that hammers and possibly one cutting blade of the hammer mill extend above the floor and into contact with the hay bale during a portion of their path of rotation. The hammers and the cutting blade cut hay from the bale and pull it into the mill where it is further ground and chopped and then ejected generally to the side of the tub grinder. A tub grinder of the type discussed is disclosed in U.S. Pat. No. 4,106,706 to Burrows.

The hammer mills in tub grinders of the type shown in U.S. Pat. No. 4,106,706 are typically oriented such that the plane of rotation of the hammers is perpendicular to the front end of the tub grinder to facilitate coupling of the hammer mill shaft to the power take off unit of a tractor used to pull the tub grinder. The mills are then designed to blow or direct hay to the side of the tub grinder.

It is advantageous in many situations to use conveyor systems in combination with tub grinders to carry the ground and chopped material further away from the grinder than it can be blown or to facilitate transfer of the material into a separate container or vessel such as a truck. Although it would be preferable to integrate such a conveyor system into the tub grinder, width considerations to permit over the road transport make it impractical to do so with side discharge hammer mills.

Further, the hammer mills in tub grinders as noted above are often ineffective when the hay to be ground or chopped is damp or wet. The damp or wet hay tends to collect on or against the internal shear plates in the hammer mill and against hammer mill side walls reducing the overall efficacy of the hammer mill and causing the hammer mill to clog up which can cause undo strain on the tractor power take off.

An additional problem with existing tub grinders of the type noted above is their inability to adequately process string and in particular plastic string used to hold the round bales of hay together. In existing tub grinders of this type, relatively long lengths of string are able to pass through the hammer mill unaffected, generally by passing along the sides of the mill and out the end generally without coming in contact with the hammers. The string can cause serious complications, including death, to cows or other livestock which ingest relatively long lengths of the undigestible string.

There is a need in the industry for an improved tub grinder with improved grinding and chopping abilities capable of processing wet hay and other feed materials and plastic string. There is also a need for such a grinder to which a conveyor may be integrally attached.

SUMMARY OF THE INVENTION

The present invention generally comprises improvements to the hammer mill of tub grinders of the type including a stationary floor secured to a frame, a tub side wall rotatably mounted relative to the floor for rotation thereabout and a hammer mill secured below the floor such that a portion of the hammer assemblies of the hammer mill extend above the floor, through a floor opening, along the upper portion of the path of rotation of the hammer assemblies. The floor and the tub side wall generally form a tub adapted to receive material to be ground and chopped such as large round bales of hay. Some type of engaging structure extends inward from the tub side wall to engage material positioned therein, to cause the material to rotate with the tub side wall and across the floor opening.

The hammer mill includes a mill housing having a front side wall, a rear side wall and an end wall extending between said front and rear side walls and which define a milling chamber. The mill housing is secured to the frame and extends below the floor such that the floor opening opens into the milling chamber. A rotor is rotatably mounted within the mill housing. A plurality of hammer assemblies are secured to and rotatable by the rotor for chopping and grinding material in the mill chamber.

The hammer assemblies generally comprise a pair of hammer bars mounted to the rotor in side by side alignment with a knife blade secured to and extending along one side of one of the hammer bars. A distal end of the knife blade extends beyond a distal end of the hammer bars. The knife blades are mounted on the side of the hammer bars facing the rotational path of travel of the material as it is rotated across the floor opening. The knife blades cut away or plane off portions of the material as it is advanced across the floor opening and the hammers pull or advance the material into the floor opening.

A spacer is secured between the hammer bars and a distal end of the spacer extends beyond a distal end of the hammer bars in spaced relation to the distal end of the knife blade. The distal end of the spacer and the distal end of the knife blade tend to keep the weight of the material off of the distal ends of the hammer bars and thereby reduce the amount of frictional resistance on the hammer assemblies.

A plurality of shear plates are secured to and extend inward from the portion of the mill housing end wall which extends coextensively with the downward portion of the path of travel of the hammer assemblies. The shear plates extend in alternating and overlapping alignment from proximate the front side wall and the rear side wall and are angled in the direction of rotation of the hammer assemblies. The angled orientation of the shear plates creates turbulence in the milling chamber causing the material therein to advance back and forth during the grinding process. Further, the angled orientation of the shear plates reduces the likelihood of wet hay from accumulating on the shear plates. A plurality of sickle blades extend into the milling chamber from the front and rear side walls between the side walls and the hammer assemblies. The sickle blades are generally oriented along the path of travel of the hammer assemblies. The sickle blades provide further chopping action in the space between the hammer mill side walls and the hammer assemblies. The sickle blades reduce the likelihood that material, including string might pass unprocessed through the mill by passing between the side walls and the hammer assemblies.

Each of the sickle blades is pivotally secured to a rear surface of the respective side wall such that a cutting portion of each sickle blade extends through a slot in the side wall and into the milling chamber and the cutting portion of each sickle blade may be pivotally advanced out of the milling chamber. The pivotal securement of the sickle blades prevents the sickle blades from being sheared off if a relatively hard object such as a rock is advanced through the milling chamber and engages the sickle blade.

A discharge opening is formed in the rear side wall of the mill housing adjacent a portion of the mill housing end wall which extends coextensively with the upward portion of the path of travel of the hammer assemblies. Deflector plates are mounted on the mill housing end wall for deflecting material in the milling chamber out the discharge opening and onto a conveyor for conveying the processed material away from the tub grinder. Any string pulled into the milling chamber by the knife blade will have to at least pass across the deflector plates before exiting the discharge opening such that the string would be subject to the grinding or chopping action between the hammer assemblies and the deflector plates reducing the likelihood that long sections of string could exit the milling chamber.

OBJECTS AND ADVANTAGES OF THE INVENTION

The objects and advantages of this invention include: providing an improved hammer mill of the type used with tub grinders in grinding and chopping animal feed and similar materials; to provide such a hammer mill which is effective at processing wet and damp hay without clogging, to provide such a hammer mill which is adapted to direct processed material rearward from the hammer mill housing; to provide such a hammer mill in association with a tub grinder which facilitates use of a conveyor secured to and extending rearwardly from the tub grinder; to provide such a hammer mill which reduces the likelihood of having materials, especially string, pass therethrough without processing; to provide such a hammer mill with an improved hammer assembly; to provide such a hammer mill in association with a tub grinder in which the hammer assembly is adapted to reduce the frictional force exerted on the rotating hammer assemblies by the weight of material held in the tub of the tub grinder; to provide such a hammer mill which effectively and consistently processes wet or dry material; to provide such a hammer mill which is relatively easy to use; and to provide such a hammer mill which is particularly well adapted for its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a tub grinder of the present invention incorporating a rotating tub, a stationary floor and a hammer mill positioned therebelow.

FIG. 2 is a fragmentary top plan view of the tub grinder as shown in FIG. 1 with portions broken away to show detail of a conveyor assembly.

DETAILED DESCRIPTION OF THE INVENTION

Figure 3:
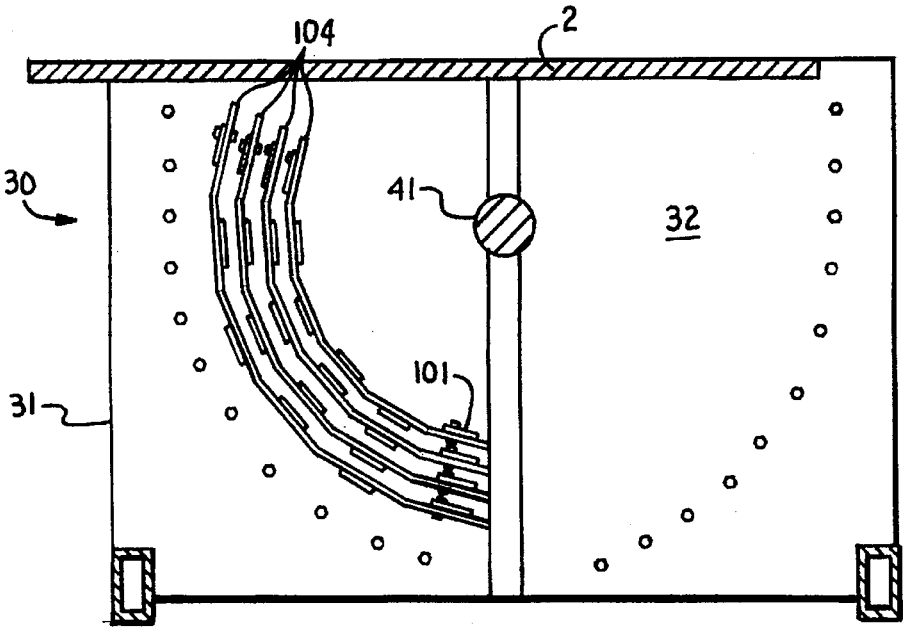
FIG. 3 is an enlarged and fragmentary cross-sectional view generally taken along line 3—3 of FIG. 1 showing a front side wall of the hammer mill.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to a tub grinder of the present invention. As shown in FIGS. 1 and 2, the tub grinder 1 includes a stationary floor 2 secured to a frame 3. A cylindrical tub side wall 4 is rotatably mounted relative to the floor for rotation thereabout. The floor 2 and the tub side wall 4 define a tub 5 for receiving material to be processed, such as animal feed and the like including large round bales of hay (not shown).

The frame 3 includes a trailer hitch 7 extending from a front end thereof. A pair of wheels 8 are mounted on opposite sides of the frame 3 to permit the tub grinder 1 to be pulled by a tow vehicle such as a tractor which is not shown. The end of the tub grinder 1 including the trailer hitch 7 is designated as the front of the tub grinder 1 and any other directional references are based on the orientation of the element when viewed looking from the front to the rear of the tub grinder 1.

The tub side wall 4 is rotatably mounted to the floor 2 by conventional roller assemblies 10 which are shown covered. The tub side wall 4 is rotatably driven by rotating means generally comprising a hydraulic motor 11 which is connected by a sprocket (not shown) to drive chain 13 which is secured to and extends around the periphery of the tub side wall 4.

A projection or wing 15 is retractably mounted in a slot on the tub side wall 4 and extends into the tub 5 for engaging material positioned therein and causing the material to rotate about the stationary floor 2 as the tub side wall 4 is rotated about the floor 2. The wing 15 is pivotally mounted on the tub side wall 4 such that a counter weighted end 17 of the wing extends outside the tub side wall 4 which urges an engaging end 18 of the wing 15 into the tub 5. It is foreseen that a wide variety of means or structure may be incorporated into the tub 5 for engaging material positioned therein and causing the material to rotate with the tub side wall 4.

A rectangular opening 25 referred to as a floor opening or mill opening is formed in and extends through the floor 2. The floor opening 25 extends perpendicular to a line extending from the front to the rear of the tub grinder. The floor opening 25 extends from near or proximate the right side of the floor 2 to slightly beyond or past the center of the floor 2. The floor opening 25 is also positioned generally half way between the front and rear of the floor 2 but slightly closer to the front of the floor 2.

A front riser or ramp 26 and a rear riser or ramp 27 are secured to and extend above the floor 2 on opposite sides of the floor opening 25 respectively. It is foreseeable that the height of the risers 26 and 27 may be adjustable. The tub side wall 4 is preferably rotated counter clockwise such that material engaged by the tub side wall 4 also rotates counter clockwise in the tub 5, and successively across the front riser 26, the floor opening 25 and the rear riser 27.

A hammer mill or mill 30 is secured to the frame 3 below the floor 2 and the floor opening 25. As shown in FIGS. 3 through 6 the mill 30 comprises a mill housing 31 having a first or front side wall 32, second or rear side wall 33 and an end wall 34 which extends between the front side wall 32 and the rear side wall 33. The end wall 34 is generally semi-circular and cooperates with the front and rear side walls 32 and 33 to define a milling chamber 35. The mill housing 31 is secured to the frame 2 of the tub grinder 1 such that the floor opening 25 opens into and communicates with the milling chamber 35.

A rotor 40 is rotatably mounted within the mill housing 31 on rotor shaft 41 which is supported on bearings (not shown) in the front and rear side walls 32 and 33. The rotor shaft 41 is connected to the power take-off unit of a tractor (not shown) by drive shaft 42. The rotor 40 generally comprises three circular rotor plates 45 mounted on the rotor shaft 41 in spaced apart relation. As shown by the arrow in FIG. 4 on rotor plate 45*a*, the rotor 40 is adapted to rotate counter-clockwise.

Figure 4:
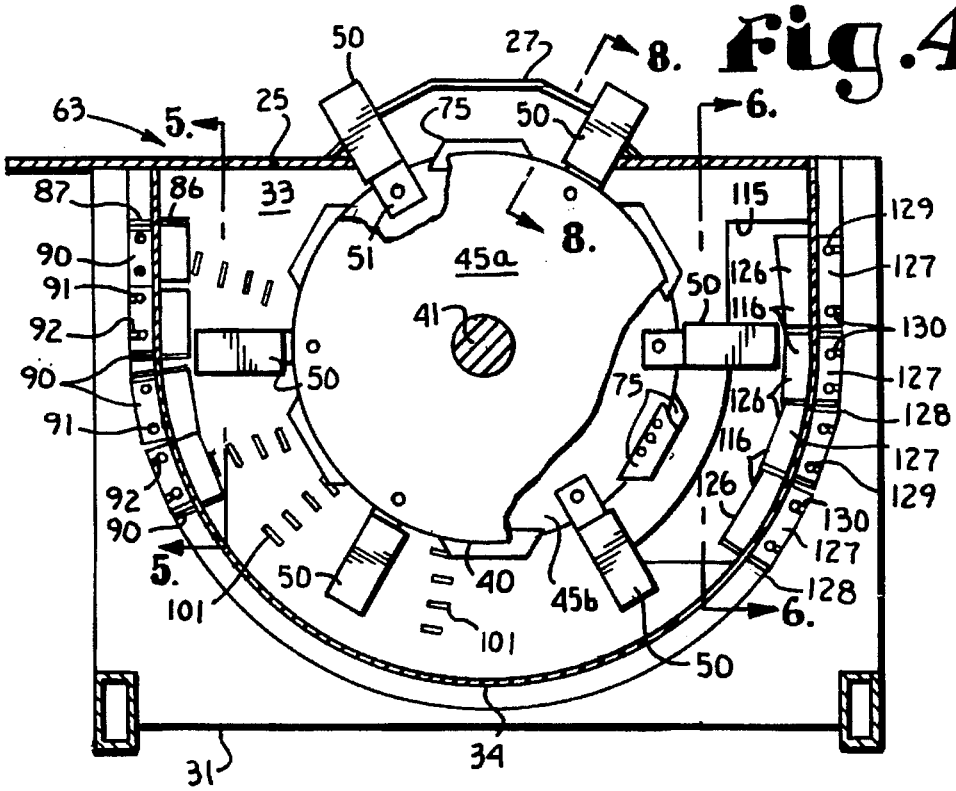
FIG. 4 is an enlarged and fragmentary cross-sectional view taken along line 4—4 of FIG. 1 showing a rotor with hammer assemblies secured thereto mounted in a milling chamber of the hammer mill.
Figure 9:
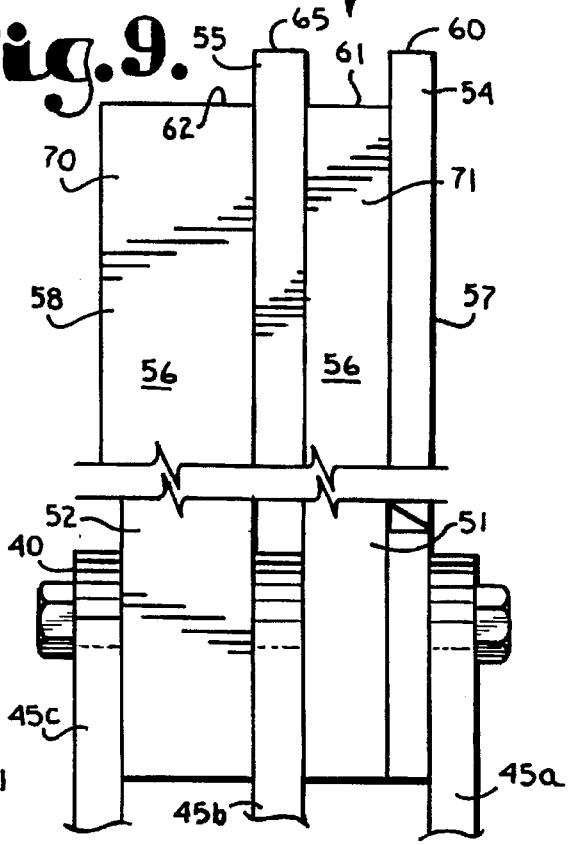
FIG. 9 an enlarged and fragmentary view taken generally along line 8—8 of FIG. 4 showing a leading face of one of the hammer assemblies.

As shown in FIG. 4, six hammer assemblies 50 are pivotally secured in equally spaced alignment on the outer periphery of the rotor 40 such that the hammer assemblies 50 are rotated counter-clockwise by rotor 40. Each hammer assembly 50, shown in greater detail in FIGS. 8 and 9, comprises front and rear hammer bars 51 and 52, a knife blade 54, a spacer 55 and a face plate 56. Each set of hammer bars 51 and 52 are mounted to the rotor 40 in side by side and spaced alignment with the knife blade 54 secured to a front side of the front hammer bar 51 such that a cutting edge 57 of the knife blade 54 extends beyond the leading side or face 58 of the hammer bars 51 and 52 in their rotational path. The front hammer bar 51 is mounted between the front and middle rotor plates 45*a* and 45*b* and the rear hammer bar 52 is mounted between the middle and rear rotor plates 45*b* and 45*c*. A distal end 60 of the knife blade 54 extends beyond distal ends 61 and 62 of the hammer bars 51 and 52 respectively.

The knife blades 54 are mounted on the front side of each front hammer bar 51 such that the cutting edge or leading edge 57 of each knife blade 54 is the first part of the hammer assembly 50 to extend across the rotational path of travel of the material as it is rotated across the floor opening 25. The knife blades 54 cut away or plane off portions of the material as it is advanced across the floor opening 25 and the face plates 56 of each hammer assembly 50 pull or knock the material through the floor opening 25 and into the milling chamber 35 at the left or intake side 63 of the mill 30.

A spacer 55 is secured between the hammer bars 51 and 52. In every other hammer assembly 50, a distal end 65 of the spacer 55 extends slightly beyond the distal ends 61 and 62 of the front and rear hammer bars 51 and 52 a distance equivalent to the distance that the distal end 60 of the knife blade 54 extends therebeyond. On these assemblies 50, the distal end 65 of the spacer 55 and the distal end 60 of the knife blade 54 tend to keep the weight of the material off of the distal ends 61 and 62 of the front and rear hammer bars 51 and 52 and thereby reduce the amount of frictional resistance on the hammer assemblies 50.

Figure 8:
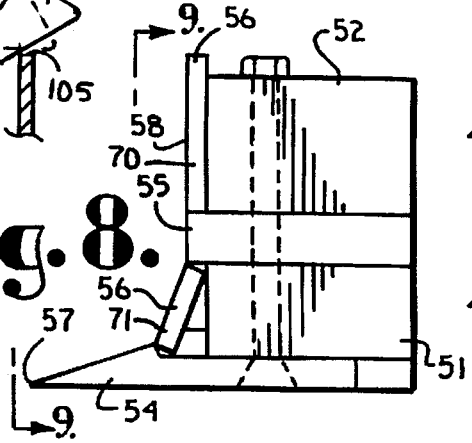
FIG. 8 is a top plan view of one of the hammer assemblies.

The face plate 56 of each hammer assembly 50 is welded to the spacer 55 and covers a substantial portion of the leading face 58 of the hammer bars 51 and 52. As shown in FIG. 8, the face plate 56 is of two piece construction, but it is readily appreciated that the face plate 56 could be of one piece construction. A distal end of each face plate 66 is flush with the distal ends 61 and 62 of the front and rear hammer bars 51 and 52. The face plate 56 includes a flat portion 70 and an angled deflecting portion 71. The flat portion 70 generally extends flush against the rear hammer bar 52 and the angled deflecting portion 71 is angled at an acute angle away from the leading face 58 of the front hammer bar 51 from the spacer 55 to the knife blade 54. The deflecting portion 71 deflects material cut by the knife blade 54 across the face plate 56 such that the material is more evenly distributed across the milling chamber 35 as it is pulled or knocked therein.

The face plate 56 is preferably formed from hardened metal to reduce wear and increase the life of the hammer assembly 50. Similarly, leading edges of the distal ends 65 of the spacers 55 which extend beyond the distal ends 61 and 62 of the hammer bars 51 and 52 as well as portions of the knife blade 54 may have layers of hardened metal added thereto to reduce the rate of wear and increase the life of these components.

As generally shown in FIG. 4, a pair of stop plates 75 are mounted on opposite sides of the middle rotor plate 45 between each pair of successive hammer assemblies 50 to limit the degree to which the hammer assemblies 50 can pivot or rotate such that successive pairs of hammer assemblies 50 do not strike each other during use.

As shown in FIG. 4, the hammer assemblies are sized and mounted such that a portion of each hammer bar 51 and 52, knife blade 54 and spacer 55 extends above the floor 2 and the risers 26 and 27 along an upper portion of the rotational path of the hammer assemblies 50 such that the portion of the assemblies 50 extending above the floor 2 and risers 26 and 27 slices off a layer of material and pulls, draws or knocks the material into the milling chamber 35 as noted above.

It is foreseen that the hammer assemblies or hammers could be of numerous configurations including hammer assemblies which include or comprise one or more blades in combination with or not in combination with a blunt or flattened face.

Figure 5:
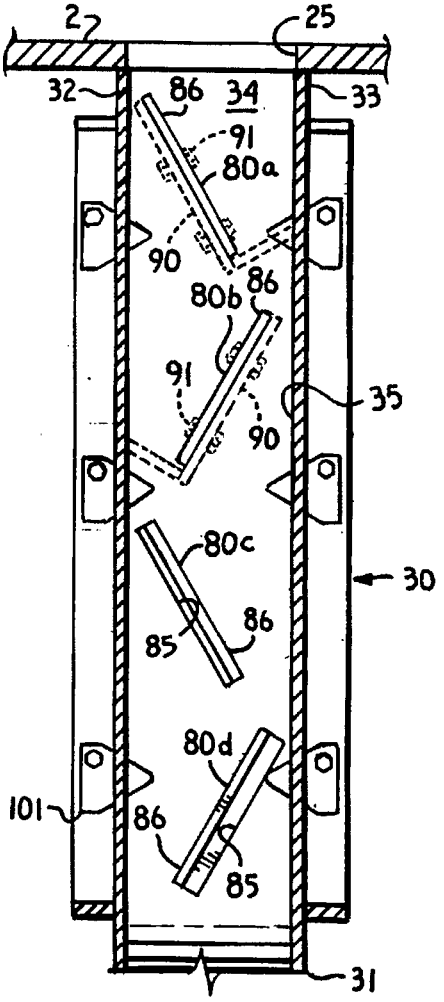
FIG. 5 is an enlarged and fragmentary cross-sectional view taken generally along the line 5—5 in FIG. 4.
Figure 6:
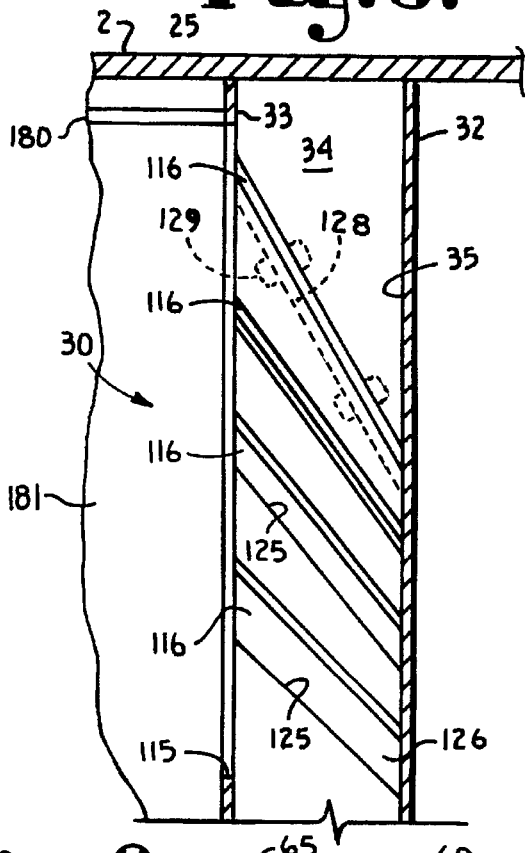
FIG. 6 is an enlarged and fragmentary cross-sectionally view taken generally along line 6—6 of FIG. 4.

As shown in FIGS. 4 and 5, four shear plates 80 are secured to and extend inward from the left side or intake side 63 of the mill housing end wall 34 which extends coextensively with the downward portion of the path of travel of the hammer assemblies 50. The shear plates 80 extend in alternating and overlapping alignment from proximate the front side wall 32 and the rear side wall 33 and are angled downward, in the direction of rotation of the hammer assemblies 50. More specifically, the front end of the first shear plate 80*a* is positioned in closely spaced relation to the front side wall 32 with a small gap extending therebetween. The first shear plate 80*a* then extends downward and toward the rear side wall 33 at an angle of approximately sixty degrees from horizontal and approximately two thirds of the distance across the end wall 34 such that the rear end of the first shear plate 80*a* is spaced away from the rear side wall 33 approximately one third of the distance between the front and rear side walls 32 and 33. The next or second shear plate 80*b* is positioned below the first shear plate 80*a*. The rear end of the second shear plate 80*b* is positioned in closely spaced relation to the rear side wall 33 with a small gap extending therebetween. The second shear plate 80*b* then extends downward and toward the front side wall 32 at an angle of approximately sixty degrees from horizontal and approximately two thirds of the distance across the end wall 34 such that the front end of the second shear plate 80*b* is spaced away from the front side wall 32 approximately one third of the distance between the front and rear side walls 32 and 33.

Each of the shear plates 80 is slidingly secured within a slot 85 extending through the end wall 34 such that an inner portion 86 extends into the milling chamber 35 and an outer portion 87 extends outside of the end wall 34, as best shown in FIG. 4. The outer portion 87 of each shear plate 80 is supported on a support bracket or plate 90, two of which are shown in phantom lines in FIG. 5, and which are welded to the outer surface of the end wall 34 adjacent the respective slot 85. Each shear plate 80 is mounted on the respective support plate 90 by bolts 91 extending through slots 92 in the shear plate 80 which permit adjustment of the distance which the inner portion 86 of each shear plate 80 extends into the milling chamber 35.

The shear plates 80 are positioned within the milling chamber 35 in spaced relation to the outer periphery of the path of rotation of the hammer assemblies 50 including the distal ends 60 and 65 of the knife blades 54 and spacers 55 respectively. Variations in the distance in the gap between the inner ends of the shear plates 80 and the outer periphery of the path of rotation of the hammer assemblies 50 varies the degree of chopping and grinding between the shear plates 80 and the hammer assemblies 50. The alternating, angled orientation of the shear plates 80 creates turbulence in the milling chamber 35 as the hammer assemblies 50 are rotated therein causing the material in the intake side of the chamber 35 to advance back and forth during the grinding process. Further, the angled orientation of the shear plates 80 reduces the likelihood of wet hay from accumulating on the shear plates 80.

A plurality of sickle blades 101 extend into the milling chamber 35 from the front and rear side walls 32 and 33 between the side walls 32 and 33 and the hammer assemblies 50. Each sickle blade 101 is generally triangular in shape and includes a base portion 102 and a cutting portion 103. The base portion 102 of each of the sickle blades 101 is pivotally secured to one of several support brackets or walls 104 which are secured to an outer surface of the front and rear side walls 32 and 33. The cutting portion 103 of each sickle blade 101 extends through a slot 105 in the respective side wall 32 and 33 and into the milling chamber 35. The cutting portion 103 of each sickle blade 101 may be pivotally advanced out of the milling chamber 35 through application of a sufficient force on the sickle blade 101. The pivotal securement of the sickle blades 101 prevents the sickle blades 101 from being sheared off if a relatively hard object such as a rock is advanced through the milling chamber 35 and engages the sickle blade 101.

Figure 7:
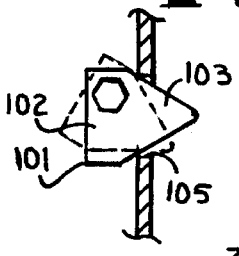
FIG. 7 is a greatly enlarged view of a portion of the hammer mill as shown in FIG. 5 with portions removed to show detail relating to the mounting of a sickle blade.

As best seen in FIG. 3, four support brackets 104 extend in quarter circular paths on the outer surface of the front side wall 32. Each support bracket 104 is formed from rectangular strips of metal welded to the respective side wall 32 and 33 in a curvilinear arrangement. Four support brackets 104 of similar configuration are secured in quarter circular paths on the outer surface of the rear side wall 33. Sickle blade slots 110, extend through the respective side walls 32 and 33 on alternating sides of each support bracket 104. Sickle blades 101 are pivotally secured by a single bolt to the support brackets 104 so as to extend through each of the sickle blade slots 110 and such that the sickle blades 101 are pivotal about the bolts as shown in FIG. 7.

The sickle blades 101 provide further chopping or cutting action in the space between the hammer mill side walls 32 and 33 and the hammer assemblies 50. The sickle blades 101 reduce the likelihood that material, including string might pass unprocessed through the mill 30 by passing between the side walls 32 and 33 and the hammer assemblies 50.

A discharge opening 115 is formed in the rear side wall 33 of the mill housing 31 adjacent the discharge or right side of the mill housing end wall 34 which extends coextensively with the upward portion of the path of travel of the hammer assemblies 50. The discharge opening 115 extends inward from the end wall 34 and is generally curved to correspond to the curve in the end wall 34.

Four deflector plates 116 are mounted on the mill housing end wall 34 adjacent the discharge opening 115 for deflecting material in the milling chamber 35 rearward out the discharge opening 115. Each of the deflector plates 116 extends substantially, entirely across the end wall 34 and is angled upward and toward the discharge opening from the front side wall 32 to the rear side wall 33 and discharge opening 115 at an angle of between approximately forty-five to sixty degrees above horizontal.

Each of the deflector plates 116 is slidingly secured within a slot 125 extending through the end wall 34 such that an inner portion 126 of each deflector plate 116 extends into the milling chamber 35 and an outer portion 127 of each deflector plate extends outside of the end wall 34. The outer portion 127 of each deflector plate 116 is supported on a support bracket or plate 128, one of which is shown in phantom lines in FIG. 6 and which are welded to the outer surface of he end wall 34 adjacent the respective slot 125. The deflector plate 116 is mounted on the support plate 128 by bolts 129 extending through slots 130 in the deflector plate 116 which permits adjustment of the distance which the inner portion 126 of each deflector plate 116 extends into the milling chamber 35.

The deflector plates 116 are positioned within the milling chamber 35 in spaced relation to the outer periphery of the path of rotation of the hammer assemblies 50 including the distal ends 60 and 65 of the knife blades 54 and spacers 55 respectively. The deflector plates 116 primarily direct material in the milling chamber 35 out the discharge opening 115. However, the deflector plates 116 also provide additional grinding and chopping action. As with the shear plates 80, the distance between the ends of the deflector plates 116 and the outer periphery of the path of rotation of the hammer assemblies 50 may be varied to vary the degree of grinding and chopping.

The knife blades 54 do have a tendency to pull some material including string into the milling chamber 35 along the gap between the hammer assemblies 50 and the front side wall 32. Before such material can be discharged from the mill 30 of the present invention, it has to pass across the mill chamber 35 to the rear side wall 33 at which point it is chopped or ground by the action of the hammer assemblies 50 with the shear plates 80 or deflector plates 116. This configuration reduces the likelihood that long sections of string would exit the milling chamber 35.

A conveyor assembly 140 having a lower conveyor section 141 and an upper conveyor section 142 is secured to and extends rearwardly from the frame 3. A lower end 145 of the lower conveyor section 141 is pivotally secured to the frame by bearings (only one shown) 146. A conveyor drive roller 151 is also rotatably mounted at bearings 146 and is driven by a hydraulic motor 154. A conveyor idler roller 157 is rotatably mounted on the distal end 158 of the upper conveyor section 142 and a conveyor belt 159 extends between and around the drive roller 151 and the idler roller 157.

A lower end 162 of the conveyor assembly upper section 142 is pivotally secured to an upper end 163 of the conveyor assembly lower section 141. A hydraulic actuator 164 secured between the upper and lower sections of the conveyor assembly 141 and 142 is operable to advance the upper section 142 between an extended position where it extends in linear alignment with the lower section 141 and a retracted position where it extends back over the lower section 141. The conveyor assembly upper section 142 is advanced to the extended position for use and to the retracted position during transport or storage of the tub grinder 1.

A hoist assembly 170 comprising a boom 171, hoist cable 172 and winch 173 is secured to the frame 3 such that the boom 171 extends above and across the conveyor assembly lower section 141. The hoist cable 172 extends from the winch 173 over a roller 175 mounted on an upper end of the boom 171 on the same side as the winch 173, rearward to a roller 176 mounted on the upper end 163 of the conveyor assembly lower section 141 on the same side as the winch 173, across the upper end 163 to a roller (not shown) mounted on the opposite side of the lower section 141 and back forward to an upper end of the boom 171 on an opposite side as the winch 173 where the end of the hoist cable 172 is fixedly secured. Using the winch 173, the conveyor assembly 140 may be pivotally raised or lowered about bearing 146.

A knock down sheet 180 extends rearward from the rear side wall 34 of the hammer mill 30 above the discharge opening 115 and the conveyor assembly 140. The knock down sheet 180 is preferably formed from a sheet of relatively durable or hard plastic with low frictional resistance. The knock down sheet 180 knocks down material blown out the discharge opening 115 onto the conveyor belt 159. Containment walls or plates 181 are secured to and extend along the sides of a lower portion of the conveyor assembly lower section 141 and across portions thereof to further knockdown and direct or confine material on the conveyor belt 159.

A clean-out auger 185 is rotatably mounted between the conveyor belt 159 proximate the conveyor drive roller 151 to auger out material from between the conveyor belt 159 to keep the conveyor assembly 140 from becoming clogged and binding. The auger is driven by the conveyor hydraulic motor 154 through conventional linkage system 186.

Windows 188 are mounted in tub side wall 4 to provide an operator with a view of the interior of the tub 5. An upwardly angled collar or flange 189 extends around the outer periphery of the upper end of the tub side wall 4 to facilitate placement of material in the tub 5. A ladder (not shown) may be secured to the frame 2 to provide access into the tub 5.

It is to be understood that while certain forms of the present invention have been illustrated and described herein, it is not to be limited to the specific forms or arrangement of parts described and shown.

What is claimed and desired to be secured by Letters Patent is as follows:

1. A tub grinder for chopping and grinding material comprising:

a. a frame;

b. a stationary floor secured to said frame and having a floor opening extending therethrough;

c. a tub side wall rotatably mounted relative to said floor for rotation thereabout by first rotating means; said floor and said tub side wall forming a tub into which material to be processed is placed;

d. a mill having a mill housing including a first side wall, a second side wall and an end wall extending between said first and second side walls and which define a milling chamber; said mill housing secured to said frame and extending below said floor such that said floor opening opens into said milling chamber;

e. a rotor rotatably secured within said mill housing and connected to second rotating means;

f. a plurality of hammer assemblies secured to and rotatable by said rotor for chopping and grinding material in said milling chamber; at least a portion of each of said hammer assemblies extending above said floor along a portion of the path of travel of said hammer assemblies during rotation for cutting and pulling material into said milling chamber;

g. at least one of said side walls of said mill housing having a discharge opening formed therein adjacent a portion of said mill housing end wall; and h. deflecting means for deflecting material in said milling chamber out said discharge opening.

2. The tub grinder as in claim 1 wherein:

a. said deflecting means comprises at least one deflector plate extending at least partially across said mill housing end wall adjacent said discharge opening.

3. The tub grinder as in claim 2 comprising:

a. a plurality of said deflector plates secured to said mill housing end wall in spaced apart relation and adjacent to said discharge opening along a portion of said end wall which is coextensive with the upward path of travel of said hammer assemblies; and b. said deflector plates are secured to said end wall by means for adjusting the distance that the deflector plates extend into said milling chamber.

4. The tub grinder as in claim 1 further comprising:

(a) a plurality of shear plates secured to and extending inward from said mill housing end wall; said shear plates extending in alternating and overlapping alignment from proximate said first side wall and said second side wall and angled in the direction of rotation of said hammer assemblies.

5. The tub grinder as in claim 4 wherein:

(a) said shear plates are secured to said end wall by means for adjusting the distance that the shear plates extend into said milling chamber.

6. The tub grinder as in claim 4 wherein:

a. each successive shear plate is spaced beyond said previous shear plate in the direction of rotation of said hammer assemblies.

7. The tub grinder as in claim 4 further comprising:

(a) a plurality of sickle blades extending into said milling chamber from at least one of said first and second side walls between said side walls and said hammer assemblies; said sickle blades being oriented along the path of travel of said hammer assemblies.

8. The tub grinder as in claim 4 wherein:

(a) at least one of said hammer assemblies comprises at least one hammer bar mounted to said rotor, a knife blade secured to and extending along one side of said hammer bar such that a distal end of said knife blade extends beyond a distal end of said hammer bar, and a spacer secured to said hammer bar and extending beyond a distal end of said hammer bar in spaced relation to said distal end of said knife blade.

9. The tub grinder as in claim 1 further comprising:

(a) a plurality of sickle blades extending into said milling chamber from at least one of said first and second side walls between said side walls and said hammer assemblies; said sickle blades being oriented along the path of travel of said hammer assemblies.

10. The tub grinder as in claim 9 wherein:

(a) each of said sickle blades is pivotally mounted to a support bracket on an outer surface of said respective first or second side wall such that a cutting portion of each said sickle blade is pivotally advanceable through a slot in said respective first or second side wall and into said milling chamber.

11. The tub grinder as in claim 10 wherein:

(a) said cutting portion of each of said sickle blades is triangular.

12. The tub grinder as in claim 1 wherein:

(a) at least one of said hammer assemblies comprises at least one hammer bar mounted to said rotor, a knife blade secured to and extending along one side of said hammer bar such that a distal end of said knife blade extends beyond a distal end of said hammer bar, and a spacer secured to said hammer bar and extending beyond a distal end of said hammer bar in spaced relation to said distal end of said knife blade.

13. The tub grinder as disclosed in claim 12 wherein:

(a) said hammer assembly comprises at least two hammer bars separated by said spacer such that said spacer extends beyond a distal end of each of said hammer bars; and (b) said knife blade is secured to one of said hammer bars along one side thereof and said distal end of said knife blade extends beyond a distal end of each of said hammer bars.

14. The tub grinder as disclosed in claim 13 further comprising:

(a) a face plate secured to a leading face of said hammer bars and having a deflecting portion secured to said hammer bar having said knife secured thereto; said deflecting portion angled toward a leading edge of said knife blade for deflecting material away from said knife blade.

15. An apparatus for chopping and grinding material comprising:

a. a material receiving receptacle having a mill opening extending therethrough;

b. a mill having a mill housing including a first side wall, a second side wall and an end wall extending between said first and second side walls and which define a milling chamber; said mill housing secured to and extending below said material receiving receptacle such that said mill opening opens into said milling chamber;

c. a rotor rotatably secured within said mill housing and connected to rotating means for rotating said rotor;

d. a plurality of hammer assemblies secured to and rotatable by said rotor for chopping and grinding material in said milling chamber; at least a portion of each of said hammer assemblies extending into said material receiving receptacle along a portion of the path of travel of said hammer assemblies during rotation for cutting and pulling material into said milling chamber;

e. at least one of said side walls of said mill housing having a discharge opening formed therein adjacent a portion of said mill housing end wall; and f. deflecting means for deflecting material in said milling chamber out said discharge opening.

16. The apparatus as in claim 15 wherein:

a. said deflecting means comprises at least one deflector plate extending at least partially across said mill housing end wall adjacent said discharge opening.

17. The apparatus as in claim 16 comprising:

a. a plurality of said deflector plates secured to said mill housing end wall in spaced apart relation and adjacent to said discharge opening; and b. said deflector plates are secured to said end wall by means for adjusting the distance that said deflector plates extend into said milling chamber.

18. The apparatus as in claim 15 further comprising:

(a) a plurality of shear plates secured to and extending inward from said mill housing end wall; said shear plates extending in alternating and overlapping alignment from proximate said first side wall and said second side wall and angled in the direction of rotation of said hammer assemblies.

19. The apparatus as in claim 18 wherein:

(a) said shear plates are secured to said end wall by means for adjusting the distance that the shear plates extend into said milling chamber.

20. The apparatus as in claim 18 wherein:

(a) each successive shear plate is spaced beyond said previous shear plate in the direction of rotation of said hammer assemblies.

21. The apparatus as in claim 18 further comprising:

(a) a plurality of sickle blades extending into said milling chamber from at least one of said first and second side walls between said side walls and said hammer assemblies; said sickle blades being oriented along the path of travel of said hammer assemblies.

22. The apparatus as in claim 18 wherein:

(a) at least one of said hammer assemblies comprises at least one hammer bar mounted to said rotor, a knife blade secured to and extending along one side of said hammer bar such that a distal end of said knife blade extends beyond a distal end of said hammer bar, and a spacer secured to said hammer bar and extending beyond a distal end of said hammer bar in spaced relation to said distal end of said knife blade.

23. The apparatus as in claim 15 further comprising:

(a) a plurality of sickle blades extending into said milling chamber from at least one of said first and second side walls between said side walls and said hammer assemblies; said sickle blades being oriented along the path of travel of said hammer assemblies.

24. The apparatus as in claim 23 wherein:

(a) each of said sickle blades is pivotally mounted to a support bracket on an outer surface of said respective first or second side wall such that a cutting portion of each said sickle blade is pivotally advanceable through a slot in said respective first or second side wall and into said milling chamber.

25. The apparatus as in claim 24 wherein:

(a) said cutting portion of each of said sickle blades is triangular.

26. The apparatus as in claim 15 wherein:

(a) at least one of said hammer assemblies comprises at least one hammer bar mounted to said rotor, a knife blade secured to and extending along one side of said hammer bar such that a distal end of said knife blade extends beyond a distal end of said hammer bar, and a spacer secured to said hammer bar and extending beyond a distal end of said hammer bar in spaced relation to said distal end of said knife blade.

27. The apparatus as in claim 26 wherein:

(a) said hammer assembly comprises at least two hammer bars separated by said spacer such that said spacer extends beyond a distal end of each of said hammer bars; and (b) said knife blade is secured to one of said hammer bars along one side thereof and said distal end of said knife blade extends beyond a distal end of each of said hammer bars.

28. The apparatus as in claim 27 further comprising:

(a) a face plate secured to a leading face of said hammer bars and having a deflecting portion secured to said hammer bar having said knife secured thereto; said deflecting portion angled toward a leading edge of said knife blade for deflecting material away from said knife blade.

* * * * *